US007377003B1

(12) United States Patent
Dochterman et al.

(10) Patent No.: US 7,377,003 B1
(45) Date of Patent: May 27, 2008

(54) COMPACTABLE PAINTBALL MARKER SQUEEGEE

(76) Inventors: Rick Dochterman, 2324 W. Locust St., Rogers, AR (US) 72756; Terry Neumaster, 108 N. Melody, Lowell, AR (US) 72745; Lester Broersma, 2050 Camino De La Reina #214, San Diego, CA (US) 92108

( * ) Notice: Subject to any disclaimer, the term of this patent is extended or adjusted under 35 U.S.C. 154(b) by 0 days.

(21) Appl. No.: 11/590,220

(22) Filed: Oct. 31, 2006

Related U.S. Application Data

(63) Continuation of application No. 10/659,539, filed on Sep. 9, 2003, now abandoned.

(60) Provisional application No. 60/452,433, filed on Mar. 5, 2003.

(51) Int. Cl.
*F41A 29/02* (2006.01)
*F16L 55/00* (2006.01)
*F16L 45/00* (2006.01)

(52) U.S. Cl. ..... 15/104.15; 15/118; 15/245; 15/144.1; 42/95

(58) Field of Classification Search ..... 15/104.16, 15/104.165, 104.2, 104.05, 118, 236.01, 245, 15/144.1–144.3; 42/95, 90
See application file for complete search history.

(56) References Cited

U.S. PATENT DOCUMENTS

| | | | | |
|---|---|---|---|---|
| 43,573 A | | 7/1864 | Crane | |
| 57,846 A | | 9/1866 | Bausman | |
| 143,139 A | | 9/1873 | Gould | |
| 1,388,560 A | * | 8/1921 | De Graff | 15/104.068 |
| 2,379,962 A | * | 7/1945 | Hoerle | 15/104.2 |
| 2,484,267 A | | 10/1949 | Bower | 15/242 |
| 3,814,525 A | * | 6/1974 | Spencer | 401/190 |
| D237,678 S | * | 11/1975 | Spencer | D22/108 |
| 4,962,607 A | * | 10/1990 | Baldwin | 42/95 |
| 5,370,105 A | | 12/1994 | Firman | 124/56 |
| 5,413,083 A | | 5/1995 | Jones | 124/32 |
| D393,115 S | * | 3/1998 | Bell et al. | D32/35 |
| 5,842,488 A | * | 12/1998 | Belleau et al. | 132/320 |
| 5,934,000 A | * | 8/1999 | Hayes, Sr. | 42/95 |
| 6,450,554 B1 | * | 9/2002 | Rotondi et al. | 292/158 |

* cited by examiner

*Primary Examiner*—Shay L Karls
(74) *Attorney, Agent, or Firm*—Keisling, Pieper & Scott PLC; David B. Pieper; Meredith K. Lowry

(57) ABSTRACT

A compactable paintball marker squeegee adapted to compact for carrying on the playing field for paintball games. The squeegee is designed to compact into smaller arrangements while providing the capability of wiping paint out a marker barrel. The present invention is designed such that the system will lock into an elongated position and may be unlocked and flipped closed with a single hand motion for compaction during play of a paintball game. Additional improvements provide for a protective design to provide improved insertion into clothing with a protected cleaning head, and improved cleaning head movements through a pear-shaped connection aperture for the pivoting head.

10 Claims, 4 Drawing Sheets

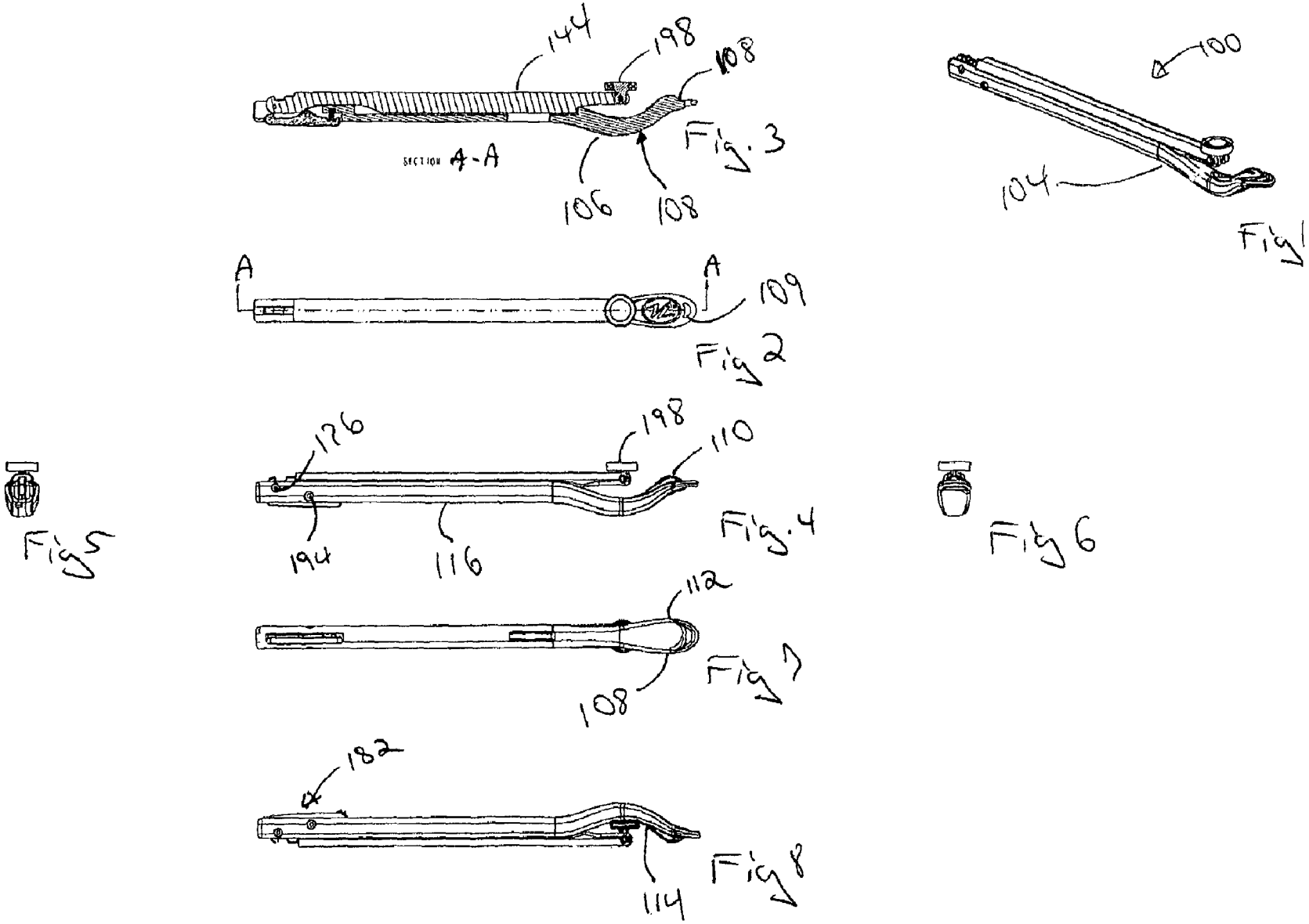
100
102
104
106
108
110
112
114
116
118
120
A
A
SECTION 4-4

100
102
104
106
108
110
112
114
116
118
120
122
124
126
128
130
132
134
136
138
140
142
144
146
148
150
152
154
156
158
160
162
164
166
168
170
172
174
176
178

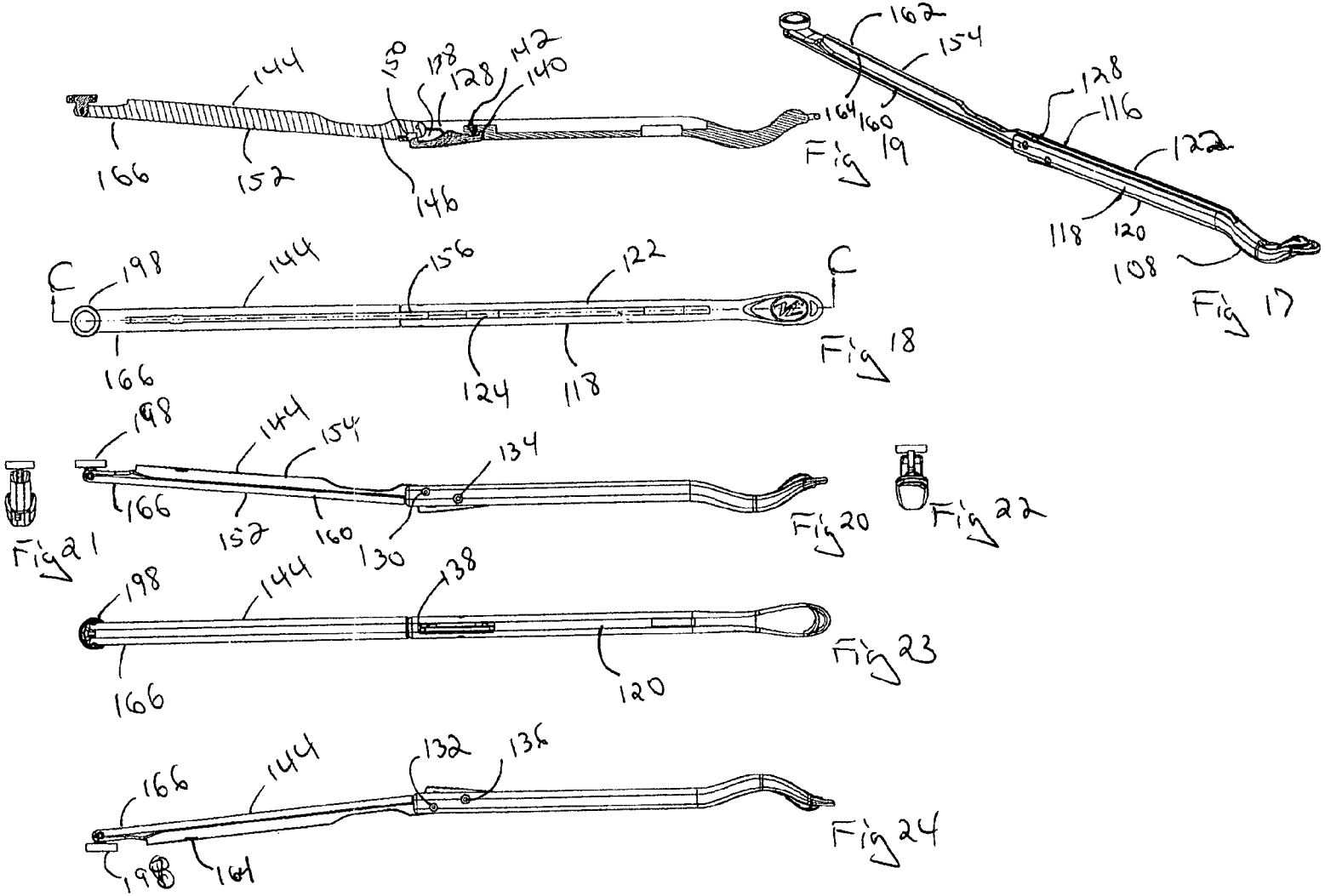

SECTION

COMPACTABLE PAINTBALL MARKER SQUEEGEE

CROSS-REFERENCE TO RELATED APPLICATIONS

This application hereby claims priority to and is a continuation of U.S. application Ser. No. 10/659,539, filed on Sep. 9, 2003 now abandoned, which claims priority to and is a continuation-in-part of U.S. provisional application Ser. No. 60/452,433, filed on Mar. 5, 2003, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of elongated projectile barrel cleaning devices in general. In particular, the present invention relates specifically to a cleaning device for provide a squeegee action for cleaning the inside of a paintball marker. Known art in various other types of cleaning devices may be found in U.S. Class 15, Brushing, Scrubbing, and General Cleaning, Subclass 104.05 Inside, Subclass 104.16 Scraper, Cutter, Wiper or Brush, Subclass 104.062 Cleaner Plug Insertion or Removal Device, Subclass 104.68 Scraper Flue Cleaner, Subclass 104.31 Sewer, Subclass 143.1 Particular Handle, Subclass 144.1 Adjustable, Subclass 144.3 Variable Length; and Class 42 Firearms, Subclass 95 For Barrel Cleaning as well as in other classes and subclasses.

2. Description of the Known Art

As will be appreciated by those skilled in the art, a solid elongated squeegee or pull through type of squeegee may be used to clean the inside of a market barrel. Details of a typical solid elongated squeegee include an inner solid tube holding a pivotal squeegee head and an outer spring biased tube to release the head and allow it to fold sideways for insertion into the barrel. The outer spring biased tube is then released to contact the inserted head to force the head into a perpendicular relationship for squeegee cleaning during removal from the barrel. Other cleaning devices include a foldable cleaner that uses a fluff or swab head on a split tube using a surgical tube connection to provide a folding action. The fluff head provide a wiping action for the inside of the barrel. However, the wiping action of the fluff head type of cleaner does not provide the level of cleaning associated with a squeegee type of action.

Several United States patents should be considered to understand cleaning devices. These include U.S. Pat. No. Des. 237,678, issued to Spencer on Nov. 18, 1975; U.S. Pat. No. Des. 393,115, issued to Bell et al. Mar. 31, 1998; U.S. Pat. No. 43,573, issued to Crane on Jul. 19, 1864; U.S. Pat. No. 5,370,105, issued to Firman on Dec. 6, 1994; U.S. Pat. No. 57,846, issued to Bausman on Sep. 11, 1866; U.S. Pat. No. 143,139, issued to Gould on Sep. 23, 1873; U.S. Pat. No. 312,206, issued to Jenks on Feb. 10, 1885; U.S. Pat. No. 426,912, issued to Butman on Apr. 29, 1890; U.S. Pat. No. 504,426, issued to Truax on Sep. 5, 1893; U.S. Pat. No. 569,060, issued to Roberts and McCormick on Oct. 6, 1896; and U.S. Pat. No. 2,484,267, issued to Bower on Oct. 11, 1949. Each of these patents are hereby expressly incorporated by reference in their entirety.

U.S. Pat. No. Des. 237,678 issued to Spencer on Nov. 18, 1975 describes a firearm chamber lubricating and cleaning device. This is a design patent which discloses the embodiment of the swab or fluff type head. It appears that a central joint or pivot is formed in the handle of this cleaning device.

U.S. Pat. No. Des. 393,115 issued to Bell et al. on Mar. 31, 1998 describes a cleaning device for paintball gun barrels. As this device does not fold, its usefulness is only in the description of the shape of the squeegee portion of the barrel cleaner.

U.S. Pat. No. 43,573 issued to Crane on Jul. 19, 1864 discloses a gun-barrel scraper which describes a compactable and expandable instrument for cleaning the interior of a barrel of a gun.

U.S. Pat. No. 5,370,105 issued to Firman on Dec. 6, 1994 discloses a squeegee holder. This patent describes the use of a flexible squeegee and swab end cleaner that may be bent and contained within a holder placed around the compressed air tank of a paint or pellet gun.

Thus, it may be seen that these prior art patents are very limited in their teaching and utilization. The prior art fails to disclose an embodiment or apparatus for providing the necessary rigidity for a compactable rod used in a cleaner having a squeegee action. Thus, an improved compactable paintball marker squeegee is needed to overcome these limitations.

SUMMARY OF THE INVENTION

The present invention is directed to a compactable paintball marker cleaner.

In accordance with one exemplary embodiment of the present invention, a compactable paintball marker cleaner is provided having a first arm with a first arm pivot end. The cleaner also has a second arm with both a second arm pivot end and a cleaner end. The second arm pivot end is pivotally connected to the first arm pivot end. An elastic squeegee scraper is connected to the second arm cleaner end to provide a compactable squeegee cleaner.

Additional advantages are found in the initial end of the first arm which has a first arm guide defining an offset insertion guide, a spreader body, and/or a tip encasing offset. The first arm may also define a compaction cavity so that a potion of the second arm can be compacted to nest in the compaction cavity of the first arm.

Further improvement may utilize a position lock that is adapted to secure the first arm in relation to the second arm to provide a rigid structure necessary for squeegee type cleaners. A unique design is provided wherein the position lock is adapted to be one hand operable for opening and closing the squeegee so that it may be quickly and easily used on the field of play.

Yet a further improvement provides for a closed position retention mechanism adapted to secure the first and second arms in a closed position. In a preferred embodiment, the closed position retention mechanism uses a frictional engagement tab connected to the second arm that is adapted to frictionally engage the first arm.

A still further improvement teaches the use of a pear shaped scraper guide aperture for controlling the pivoting of the elastic squeegee scraper.

One embodiment teaches a compactable paintball marker squeegee that uses a first elongated body, a second elongated body adapted to be positioned in connection with the first elongated body to provide both an extended cleaning position and a compacted storage position along with a squeegee end cleaner connected to the second arm.

A further embodiment teaches a compactable paintball marker cleaner having a first arm defining a compaction cavity with a second arm adjustably connected to the first arm to be positioned in both an extend position and a compacted position, wherein at least a portion of the second arm is adapted to nest within the compaction cavity of the first arm. This embodiment also uses a cleaner head connected to the cleaning rod.

A still further embodiment teaches a paintball marker cleaner having an elastic squeegee scraper connected to an arm. The operation of this basic embodiment of the scraper is controlled by a pear shaped scraper guide aperture in the arm.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 3 is a cutaway view of the embodiment of FIG. 2 along line A-A.

FIG. 4 is a left side view of the embodiment of FIG. 1.

FIG. 12 is a left side view of the embodiment of FIG. 9.

FIG. 13 is a back view of the embodiment of FIG. 9.

FIG. 14 is a front view of the embodiment of FIG. 9.

FIG. 15 is a bottom view of the embodiment of FIG. 9.

FIG. 16 is a right side view of the embodiment of FIG. 9.

FIG. 17 is an isometric view of the compactable squeegee of FIG. 1 in a slightly closed position.

FIG. 18 is a top view of the embodiment of FIG. 17.

FIG. 19 is a cutaway view of the embodiment of FIG. 18 along line C-C.

FIG. 20 is a left side view of the embodiment of FIG. 17.

FIG. 21 is a back view of the embodiment of FIG. 17.

FIG. 22 is a front view of the embodiment of FIG. 17.

FIG. 23 is a bottom view of the embodiment of FIG. 17.

FIG. 24 is a right side view of the embodiment of FIG. 17.

FIG. 25 is a top view of the squeegee in a fully open position with the squeegee perpendicular for use inside a marker barrel.

FIG. 26 is a cutaway view of the embodiment of FIG. 25 along line D-D.

DETAILED DESCRIPTION OF THE INVENTION

Figures 5, 6, 7, 8, 9, 10, 11:
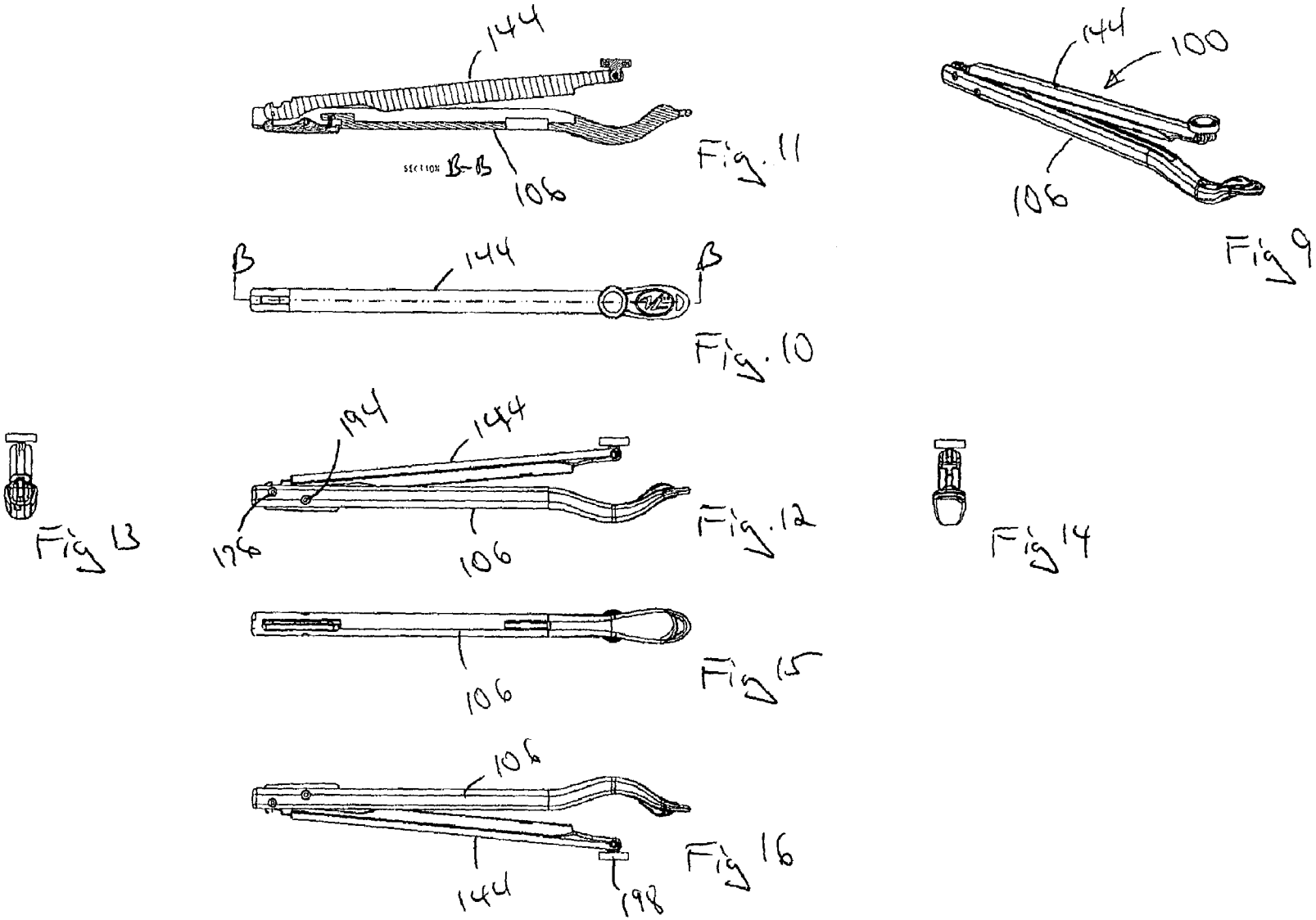
FIG. 5 is a back view of the embodiment of FIG. 1.
FIG. 6 is a front view of the embodiment of FIG. 1.
FIG. 7 is a bottom view of the embodiment of FIG. 1.
FIG. 8 is a right side view of the embodiment of FIG. 1 with the squeegee head pivoted into a compacted position.
FIG. 9 is an isometric view of the compactable squeegee of FIG. 1 in a slightly open position.
FIG. 10 is a top view of the embodiment of FIG. 9.
FIG. 11 is a cutaway view of the embodiment of FIG. 10 along line B-B.
Figures 1, 2:
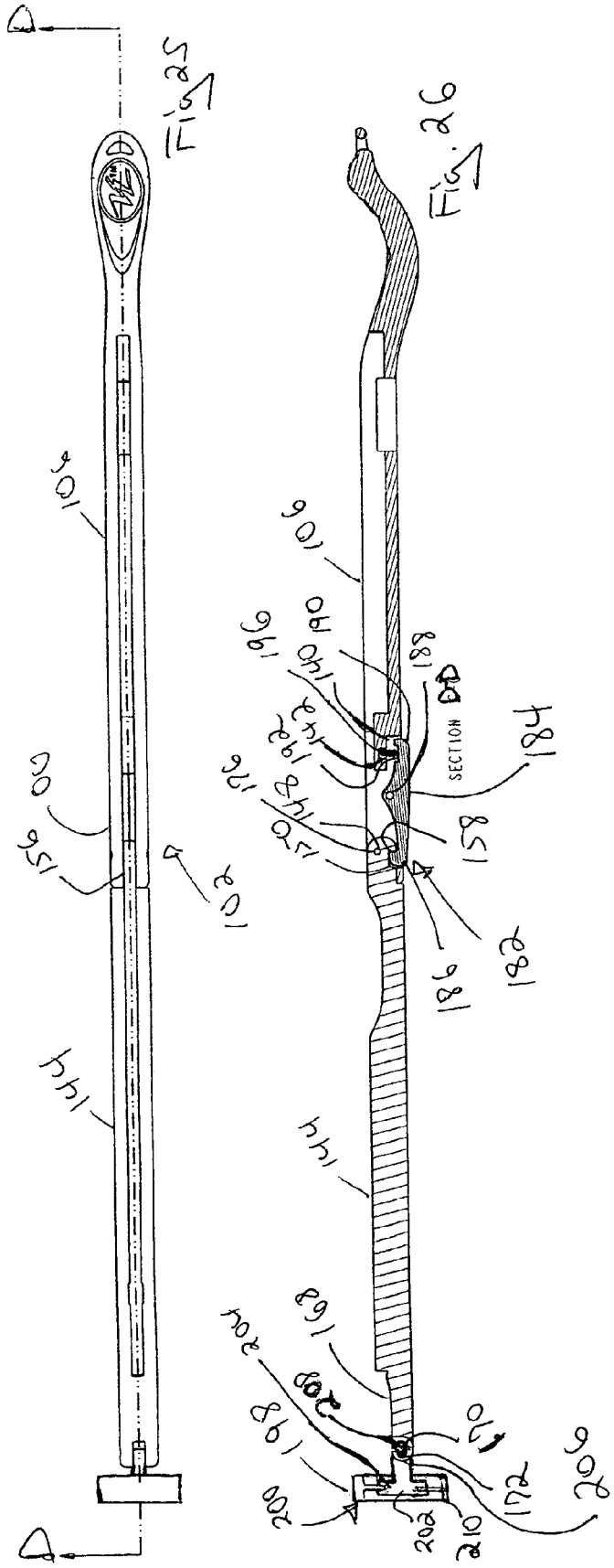
FIG. 1 is an isometric view of an exemplary embodiment of the compactable squeegee.
FIG. 2 is a top view of the embodiment of FIG. 1.

As shown in FIGS. 1-26 of the drawings, one exemplary embodiment of the present invention is generally shown as a compactable paintball marker squeegee 100. FIGS. 25 and 26 show the compactable paintball marker cleaner 100 in an extend position 102, also referred to as a cleaning position 102 in which it operates as ram type squeegee. One unique aspect of the present invention is shown in FIGS. 1 through 8 which show the squeegee 100 in a compacted position 104, also known as a storage position 104. The compactable paintball marker squeegee 100 uses a first elongated arm 106 pivotally connected to a second elongated arm 144 for compaction while still provided the rigid capability for using a squeegee type of cleaner head 198.

The first elongated arm 106 includes a tip protector 108 which provides several advantages. The tip protector 108 has a first arm guide 108 that allows for easy insertion of the squeegee 100 into a pocket or sleeve on clothing. A lanyard loop 109 is also provided in this guide 108. One advantage of the tip protector 108 of the present invention is that it provides an offset insertion guide 110 to protect the cleaner head 198 during the insertion process. A still further advantage is provided by the tip protector 108 because it is widened to form a spreader body 112 to further protect the cleaner head 198 during the clothing insertion process. The tip protector 108 also has a curved internal radius to form a tip encasing offset 114 so that the head 198 may be pivoted into the tip encasing offset 114 for protection as shown in FIG. 8.

The tip protector 108 of the first elongated arm 106 is connected to the main first body 116. The main first body 116 is constructed from a first side wall 118 and a second side wall 122 connected to a base wall 120. These walls define an elongated cavity 124 which operates as a compaction aperture 124, also known as a compaction cavity 124, along the length of the first elongated arm 106.

The distal end of the first elongated arm 106 is shown as a first arm hinge wing end 128, also known as a first arm pivot end 128. The first arm pivot end 128 defines a left pivot pin aperture 130 and a right pivot pin aperture 132 as well as a left lock pin aperture 134 and a right lock pin aperture 136. The first elongated arm 106 further defines a lock arm cavity 138 for the lock arm 184 which defines a pivot end cavity 140 allowing operation of the lock arm 184 and a spring seat 142.

The second elongated arm 144 includes a second arm wing end 146, also known a second arm pivot end 146 includes a hinge extension 156 defining a central pivot pin aperture 148 and a lock arm catch 150. The first arm hinge wing end 128 and second arm wing end 146 are pivotally connected to provide the compacting action of the present invention. The second arm wing end 146 is connected to the main second body 152 which is constructed from a central wall 154, also known as a center wall 154 and a back wall 160 in a T-shape. The lock arm catch 150 is shown as a lock encasing offset 158 which operates with the locking finger 186 of the lock arm 184.

A closed position retention mechanism 162 is shown mounted on the center wall 154 and is shown as a friction retaining projection 164, also known as an engagement tab 164 which is adapted to wedge inside the compaction cavity 124 of the first elongated arm 106 to hold the squeegee 100 in a compacted position.

The distal end of the second arm defines a second arm tip end 166, also known as a second arm cleaner end 166. The second arm cleaner end 166 has a tip extension 168 which defines a pear-shaped aperture 170, also known as a pear-shaped scraper guide 170. This pear shaped scraper guide 170 provides additional control by providing a central pulling position and a variable offset for side pivot positions. As the squeegee 100 is pulled down the length of the marker barrel, the pear shaped scraper guide 170 guides the pin ears 208 of the cleaner head 198 to a central position in the barrel. The friction of the cleaner head 198 against the marker barrel pulls the cleaner head 198 into the narrow end 172 of the pear shaped aperture 170 and pivots the head 198 into a substantially perpendicular position for cleaning the barrel as shown in FIGS. 25-26. Once the cleaner head 198 is free from the marker barrel, the larger portion of the pear shaped scraper guide 170 allows the head to rest against the second arm tip end 166 and transfer any impacts which would break the pivoting connections used on prior art designs. Thus, the present invention improves the operation of the cleaner head 198 by allowing for increases breakage resistance while still providing for the requisite cleaning action.

The hinge 174 connecting the first elongated arm 106 to the second elongated arm 144 is a simple design using a pivot pin 176 with an appropriate pin diameter and pin length to wedge in place in the arms 106, 144 and provide a pivotal motion.

The position lock 182 uses a lock arm 184 having a locking finger 186 to engage the second arm 144. The lock arm 184 is positioned so that a downward force will release the second arm 144 to allow pivoting movement of the arms 106, 144. In this manner, the same operator hand that holds the squeegee 100 may press the lock release handle 190 to open the lock 182. Thus, the lock is one hand operable. The lock arm 184 defines a pivot aperture 188 for providing the pivotal motion of the lock arm 184 on a lock pivot pin 194 held in place in the first elongated arm 106. The lock arm 184 also includes the release handle 190 defining a spring recess 192 for retaining the lock spring 196 which biases the lock 182 in an engaged position.

The cleaner head 198 is attached to the end of the second elongated arm 144. The cleaner head 198 is also known as a squeegee end cleaner 198 and includes a scraper tip 200 having a tip body 202 and a elastic squeegee scraper 210. The tip body 202 includes a scraper support 204 connected to a pivot projection 206 having pin ears 208 for connection into the second elongated arm 144.

Reference numbers used throughout the specifications and drawings refer to the following:

Compactable paintball marker squeegee 100
compactable paintball marker cleaner 100
an extend position 102
cleaning position 102
compacted position 104
storage position 104
first elongated arm 106
tip protector 108
first arm guide 108
lanyard loop 109
offset insertion guide 110
spreader body 112
tip encasing offset 114
main first body 116
first side wall 118
base wall 120
second side wall 122
elongated cavity 124
compaction aperture, compaction cavity 124
compaction cavity 124
first arm hinge wing end 128
first arm pivot end 128
left pivot pin aperture 130
right pivot pin aperture 132
left lock pin aperture 134
right lock pin aperture 136
lock arm cavity 138
pivot end cavity 140
spring seat 142
second elongated arm 144
second arm wing end 146
second arm pivot end 146
central pivot pin aperture 148
lock arm catch 150
main second body 152
central wall 154
center wall 154
hinge extension 156
lock encasing offset 158
back wall 160
closed position retention mechanism 162
friction retaining projection 164
engagement tab 164
second arm tip end 166
second arm cleaner end 166
tip extension 168
pear-shaped aperture 170
pear-shaped scraper guide 170
narrow end 172
hinge 174
pivot pin 176
pin diameter 178
pin length 180
position lock 182
lock arm 184
locking finger 186
pivot aperture 188
release handle 190
spring recess 192
lock pivot pin 194
lock spring 196
cleaner head 198
squeegee end cleaner 198
scraper tip 200
tip body 202
scraper support 204
pivot projection 206
pin ears 208
elastic squeegee scraper 210

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A compactable paintball marker cleaner for a paintball marker having a barrel with an internal shape, comprising:

a first arm having a first arm pivot end;

a second arm having a second arm pivot end and a cleaner end, the second arm pivot end pivotally connected to the first arm pivot end; and an elastic squeegee scraper having a circular edge shape to clean the inside of the barrel and connected to the second arm cleaner end;

the second arm cleaner end defining a pear shaped scraper guide aperture for controlling the pivoting of the elastic squeegee scraper, the pear shaped scraper guide aperture adapted to allow the cleaner end to pivot from an unbiased position parallel to the second arm to an extracting position substantially perpendicular to the second arm whereby the circular edge of the elastic squeegee scraper is then biased against the perimeter of the interior of the paintball barrel.

2. The apparatus of claim 1, the first arm having a base wall, a first side wall, and a second side wall defining a compaction aperture;

the second arm having a center wall and a back wall, wherein at least a portion of the center wall is adapted to fit within the compaction aperture.

3. The apparatus of claim 1, the first arm further comprising:

a first arm guide defining an offset insertion guide.

4. The apparatus of claim 1, the first arm further comprising:

a first arm guide defining a spreader body.

5. The apparatus of claim 1, the first arm further comprising:

a first arm guide defining a tip encasing offset.

6. The apparatus of claim 1, further comprising:

a position lock adapted to secure the first arm in relation to the second arm.

7. The apparatus of claim 6, wherein the position lock is adapted to be one hand operable for opening and closing the cleaner.

8. The apparatus of claim 6, further comprising:

a closed position retention mechanism adapted to secure the first and second arms in an closed position.

9. A paintball marker cleaner for a paintball marker having a barrel with an internal shape, comprising:

an elastic squeegee scraper having a circular edge shape to clean the inside of the barrel;

a first arm having a first arm pivot end and a cleaner end, the cleaner end defining a pear shaped scraper guide aperture for controlling the pivoting of the elastic squeegee scraper, the pear shaped scraper guide aperture adapted to allow the cleaner end to pivot from an unbiased position parallel to the first arm to an extracting position substantially perpendicular to the first arm from a position parallel to the first arm whereby the circular edge of the elastic squeegee scraper is then biased against the perimeter of the interior of the paintball barrel.

10. The apparatus of claim 9, further comprising:

a second arm having a first arm pivot end pivotally connected to the first arm pivot end.

* * * * *